US012662996B2

(12) United States Patent
Warner et al.

(10) Patent No.: US 12,662,996 B2
(45) Date of Patent: Jun. 23, 2026

(54) DOUBLE ACTING TWO STAGE PISTON TYPE PUMP

(71) Applicant: ZF CV Systems Europe BV, Brussels (BE)

(72) Inventors: Simon Warner, Pontefract (GB); Paul Wellings, Pontefract (GB); Rahman Basheer, Chennai (IN)

(73) Assignee: ZF CV Systems Europe BV, Brussels (BE)

( * ) Notice: Subject to any disclaimer, the term of this patent is extended or adjusted under 35 U.S.C. 154(b) by 0 days.

(21) Appl. No.: 19/035,638

(22) Filed: Jan. 23, 2025

(65) Prior Publication Data

US 2025/0237203 A1 Jul. 24, 2025

(30) Foreign Application Priority Data

Jan. 23, 2024 (IN) ..... 202411004597

(51) Int. Cl.

| | |
|---|---|
| ***F04B 35/01*** | (2006.01) |
| ***F04B 25/00*** | (2006.01) |
| ***F04B 37/14*** | (2006.01) |
| ***F04B 53/14*** | (2006.01) |

(52) U.S. Cl.

CPC ..... *F04B 35/01* (2013.01); *F04B 25/005* (2013.01); *F04B 53/147* (2013.01); *F04B 37/14* (2013.01)

(58) Field of Classification Search

None

See application file for complete search history.

(56) References Cited

U.S. PATENT DOCUMENTS

| | | | | | |
|---|---|---|---|---|---|
| 1,620,870 | A * | 3/1927 | Carrey | F04B 3/003 | 417/547 |
| 2,010,377 | A * | 8/1935 | Sassen | F04B 13/00 | 417/539 |
| 3,839,946 | A * | 10/1974 | Paget | F04B 39/0005 | 92/170.1 |
| 4,190,402 | A * | 2/1980 | Meece | F04B 35/04 | 92/155 |
| 5,515,769 | A * | 5/1996 | Basinski | F04B 39/04 | 92/169.1 |
| 5,957,667 | A * | 9/1999 | Epp | F04B 37/18 | 417/372 |

(Continued)

FOREIGN PATENT DOCUMENTS

| | | |
|---|---|---|
| WO | 2017/137141 A1 | 8/2017 |
| WO | 2017/137144 A1 | 8/2017 |
| WO | 2019/114923 A1 | 6/2019 |

*Primary Examiner* — Dominick L Plakkoottam
*Assistant Examiner* — Geoffrey S Lee
(74) *Attorney, Agent, or Firm* — Walter Ottesen, P.A.

(57) ABSTRACT

A double acting two stage piston type pump includes a pump housing having a piston arrangement connected to a driving shaft which, when driven, sets the piston arrangement into movement. The piston arrangement has at least two primary stage pistons, the primary stage pistons being slidably seated in respective primary stage cylinders formed in the pump housing. The piston arrangement also includes at least two secondary stage pistons slidably seated in respective secondary stage cylinders formed in the primary stage pistons. The primary stage pistons and the secondary stage pistons are mounted on, and directly driven by, eccentrics mounted on the driving shaft.

15 Claims, 5 Drawing Sheets

(56) References Cited

U.S. PATENT DOCUMENTS

| | | | | |
|---|---|---|---|---|
| 6,485,266 | B2 * | 11/2002 | DeRuyter | F04B 39/066 417/415 |
| 6,832,900 | B2 * | 12/2004 | Leu | F04B 39/0027 417/523 |
| 8,128,382 | B2 * | 3/2012 | Smits | F04B 39/12 417/415 |
| 9,441,619 | B2 * | 9/2016 | Ito | F04B 53/006 |
| 9,574,531 | B2 * | 2/2017 | Qin | F02M 39/02 |
| 11,300,110 | B2 * | 4/2022 | Todman | F04B 9/045 |
| 2014/0245582 | A1 * | 9/2014 | Kim | B23P 11/00 29/240 |
| 2014/0294636 | A1 * | 10/2014 | Ito | F04B 39/0094 417/521 |
| 2015/0078932 | A1 | 3/2015 | Ruiz Martinez | |
| 2019/0010937 | A1 | 1/2019 | Bredbeck et al. | |
| 2019/0055935 | A1 * | 2/2019 | Ohata | F04B 35/04 |
| 2020/0309103 | A1 * | 10/2020 | Todman | F04B 27/02 |
| 2021/0215148 | A1 * | 7/2021 | Mayorca | F04B 27/005 |

* cited by examiner

DOUBLE ACTING TWO STAGE PISTON TYPE PUMP

CROSS-REFERENCE TO RELATED APPLICATIONS

This application claims priority of Indian patent application no. 202411004597, filed Jan. 23, 2024, the entire content of which is incorporated herein by reference.

TECHNICAL FIELD

The disclosure relates to a pump, in particular a vacuum pump, including a pump housing having a piston arrangement connected to a drive shaft which, when driven, sets the piston arrangement into movement, wherein the piston arrangement includes a first primary stage piston, the first primary stage piston being slidably seated in a first primary stage cylinder which is formed in the pump housing, and a second primary stage piston, the second primary stage piston being slidably seated in a second primary stage cylinder which is formed in the pump housing. The piston arrangement also includes a first secondary stage piston which is slidably seated in a first secondary stage cylinder formed in the first primary stage piston, and a second secondary stage piston which is slidably seated in a second secondary stage cylinder formed in the second primary stage piston. Such pumps may be used to induce a vacuum at the pump inlet and/or to provide pressurized fluid at the pump outlet.

BACKGROUND

Vacuum pumps are for example known from WO 2017/137144 A1 or US 2019/0010937. Such vacuum pumps are generally referred to as piston type vacuum pumps in distinction from so-called rotary vane vacuum pumps. Pumps of the aforementioned types include at least one piston which reciprocatingly moves inside a cylinder. The pump inlet usually is connected with the working chamber formed by the cylinder such that when the piston moves inside the cylinder for increasing the working volume of the working chamber the vacuum is induced at the inlet. For even increasing this vacuum, such piston type vacuum pumps often include primary and secondary stages, wherein the secondary stage further increases the vacuum generated by the primary stage.

Pumps of this type are used in passenger vehicles or trucks as in particular vacuum pumps to supply specific modules of the vehicle with a vacuum. This vacuum, for example, is used for brake boost modules, or for pneumatic braking systems in trucks. For common gasoline or diesel engine vehicles the vacuum pump was typically mounted in the engine region and connected to the crank shaft of the engine to be driven. Modern vehicles, however, include improved electric systems such that also vacuum pumps of modern vehicles are more often driven by an electric motor. The present disclosure particularly relates to such vacuum pumps, which are driven by an electric motor inside a vehicle.

Problems associated with piston type pumps in the field of vehicles are in particular noise and vibration generation. This in particular is true for single piston one stage piston type pumps. Two stage piston pumps are more balanced from a torque perspective, since the two stages can be driven alternatingly. However, such common two stage piston pumps often suffer a higher out of balance inertia loading which again translates to higher noise and vibration levels.

One piston type vacuum pump, which is balanced in an improved manner, is disclosed in US 2015/0078932 A1. However, this vacuum pump is rather complicated and involves multiple different parts. Moreover, the vacuum pump disclosed in US 2015/0078932 A1 is relatively large compared to common vane type vacuum pumps.

WO 2019/114923 A1 shows a piston type pump, including a pump housing having at least one pump inlet and one pump outlet and a piston arrangement connected to a driving shaft which, when driven, sets the piston arrangement into movement, wherein the piston arrangement includes a first primary stage piston, the first primary stage piston being slidably seated in a first primary stage cylinder formed in the pump housing; a first secondary stage piston; whereas the first secondary stage piston is slidably seated in a first secondary stage cylinder formed in the first primary stage piston. Such a piston type pump is formed as a so-called twin piston type pump and therefore also includes a second primary stage piston and a second secondary stage piston, wherein the second primary stage piston is slidably seated in a second primary stage cylinder formed in the pump housing, and the second secondary stage piston is slidably seated in a second secondary stage cylinder formed in the second primary stage piston.

In the piston type pump of WO 2019/114923 A1, the piston arrangement is set into movement thanks to sliding block guides that connect the pistons to respective eccentrics mounted on the driving shaft. In other words, a so-called "Scotch yoke" mechanism is used to convert the rotational movement of the driving shaft into the sliding movement of the block guides and then into the linear movement of the pistons.

However, in the context of piston type pumps, the "Scotch yoke" mechanism carries several problems. In particular, it does not represent a robust solution and leads to wear and noise issues. Also, such an arrangement leads to high power consumption. Furthermore, the "Scotch yoke" configuration features the crank as part of the piston pack: the diameter of the operating bore therefore tends to become a constraint, preventing the use of adequately sized bearings.

SUMMARY

It is an object of the disclosure to provide a more robust piston type pump which allows to achieve better durability. Another object of the present disclosure is to provide a piston type pump which features lower noise and power consumption. Another object of the present disclosure is to provide a piston type pump which allows a more compact configuration and that is easier to assemble and manufacture. Another object of the present disclosure is to provide a piston type pump which avoids the issue of linear sliding motion at the bearings and permits the use of larger rolling element bearings.

These and other objects are, for example, achieved by a piston type pump including a pump housing having a piston arrangement connected to a driving shaft which, when driven, sets the piston arrangement into movement. Such a piston arrangement includes: a first primary stage piston, the first primary stage piston being slidably seated in a first primary stage cylinder formed in the pump housing; a first secondary stage piston, the first secondary stage piston being slidably seated in a first secondary stage cylinder formed in the first primary stage piston; a second primary stage piston, the second primary stage piston being slidably seated in a second primary stage cylinder formed in the pump housing; a second secondary stage piston, the second secondary stage piston being slidably seated in a second secondary stage cylinder formed in the second primary stage piston.

The driving shaft of the piston type pump of the disclosure includes a first eccentric and a second eccentric, which are phase shifted by 180°; furthermore, the first secondary stage piston includes a first secondary stage piston rod and the second secondary stage piston includes a second secondary stage piston rod.

The piston type pump of the disclosure is characterized in that the first primary stage piston and the second secondary stage piston rod are mounted on, and directly driven by, the second eccentric and in that the first secondary stage piston rod and the second primary stage piston are mounted on, and directly driven by, the first eccentric.

The direct driving of the primary and of the secondary stage pistons by the eccentrics permits the direct conversion of the rotary motion of the driving shaft into the linear, reciprocating motion of the pistons, thus disposing of any intermediate sliding mechanism.

Where in the following reference is made to a pump or vacuum pump, it shall also be noted that this pump may also be used as a compressor. Whether it is used as a compressor or a vacuum pump is mainly dependent on how consumers are connected to the pump inlet and/or pump outlet. As a preferred use of the disclosed pump is the vacuum generation, the embodiments are mainly described with respect to the vacuum pump application.

The pump of the disclosure is based on the idea that the space within the primary stage pistons, which usually have a larger piston face than the secondary stage pistons, is used for forming the secondary stage cylinders, in which the secondary stage pistons can move in a reciprocating manner. Due to this arrangement, the overall size of the pump can be reduced. The second stage is formed inside the first stage and not adjacent to it or at any other position. While the primary stage pistons move relative to the pump housing inside respective primary stage cylinders formed inside the pump housing, the secondary stage pistons move inside the primary stage pistons. For inducing a vacuum of the second stage it is thus necessary that the secondary stage pistons move relative to the primary stage pistons and preferably also relative to the pump housing.

Preferably, when the disclosure relates to a vacuum pump, the secondary stage cylinders have a bigger volume than the primary stage cylinders.

Even more preferably, the secondary stage cylinders of the vacuum pump of the disclosure may have a volume that is approximately 10% larger than the volume of their respective primary stage cylinders.

According to an aspect, when the disclosure relates to a vacuum pump, the secondary stage cylinders have a bigger volume than the primary stage cylinders due to the fact that the stroke of the secondary stage pistons is approximately twice as long as that of the primary stage pistons.

Preferably, when the disclosure relates to a compressor, the secondary stage cylinders have a smaller volume than the primary stage cylinders.

In an embodiment of the pump, the drive shaft of the pump includes a first eccentric and a second eccentric, which are phase-shifted by 180°, wherein a first primary stage piston and a second secondary stage piston are driven by the second eccentric, and wherein a first secondary stage piston and a second primary stage piston are driven by the first eccentric. It shall be understood that since the secondary stage pistons move inside the primary stage pistons, they are connected to the eccentrics via rods, which move together with their respective secondary stage pistons. Furthermore, it shall be understood that also other phase shifting can be preferred, dependent on the overall configuration of the pump. For example, pumps are known which use a 90 degree phase shift or a 120 degree phase shift. A 180° phase shift however has shown to be most efficient and a very well balanced pump can be achieved.

In a further development the first eccentric includes a first eccentricity with respect to a rotational axis of the drive shaft and the second eccentric includes a second eccentricity with respect to the rotational axis. The first eccentricity preferably is identical to the second eccentricity, so that respective piston strokes can be identical. However, when different piston strokes are desired, the first and second eccentricities may vary from each other.

According to an aspect, the first and second eccentrics are integrally formed with the drive shaft. Thus, the drive shaft, the first eccentric and the second eccentric are formed in a one-piece construction which makes it possible to reduce parts for the piston type pump.

According to an aspect, the first and the second eccentrics are separate components, which allow for a simple manufacturing and mounting. According to an aspect, the pistons and/or the piston rods are mounted on the eccentrics via respective bearings, for instance needle bearings.

In an embodiment, the driving shaft includes a stud, and the first and the second eccentrics are mounted on the stud. According to an aspect, the driving shaft and/or the stud, the first eccentric and the second eccentric are separate components. According to an aspect, the driving shaft and/or the stud, the first eccentric and the second eccentric are formed into a single component.

According to an aspect, at least the first eccentric and/or at least the second eccentric is fixedly mounted on the stud. According to an aspect, at least the first eccentric and/or at least the second eccentric is in threaded engagement with the stud.

In a further embodiment, the first eccentric is provided with a first torque-transmitting and aligning arrangement configured to engage, in a predetermined angular way, with a respective second torque-transmitting and aligning arrangement provided on the second eccentric. Preferably, the first torque-transmitting and aligning arrangement includes a first form locking element, and the second torque-transmitting and aligning arrangement includes a second form locking element, engaging the first form locking element. According to an aspect, the first torque-transmitting and aligning arrangement provided on the first eccentric includes at least a first and preferably a second protrusion. The second torque-transmitting and aligning arrangement provided on the second eccentric preferably includes at least one third protrusion configured to fit with the at least first and preferably second protrusions provided on the first eccentric.

According to an aspect, such first and second torque-transmitting and aligning arrangements allow the first and second eccentrics to be rotationally positioned at a predetermined angle, for instance at 180°.

According to an aspect, such first and second torque-transmitting and aligning arrangements allow the first and second eccentrics to transmit torque and jointly rotate together with the driving shaft and/or the stud. Moreover, they allow for a simple manufacturing and mounting. According to an aspect, the first torque-transmitting and aligning arrangement provided on the first eccentric and the second torque-transmitting and aligning arrangement provided on the second eccentric are located in proximity to the stud to minimize inertia forces. According to an aspect, a nut is threadedly engaged to the stud and in contact force transmitting engagement with the second eccentric.

According to a second, alternative embodiment, the driving shaft includes a cap screw and the first and second eccentrics are mounted on such a cap screw. According to an aspect, at least the first eccentric and/or at least the second eccentric is fixedly mounted on the cap screw. According to an aspect, at least the first eccentric and/or at least the second eccentric is in threaded engagement with the cap screw. According to an aspect, the second eccentric is provided with a flange configured to fit with a recess provided on the first eccentric.

According to an aspect, the piston type pump of the disclosure according to the second, alternative embodiment, also includes a pin configured to fixedly secure the flange provided on the second eccentric with the recess provided on the first eccentric. Preferably, the pin is interference mounted in respective bores provided in both the flange and the recess.

According to an aspect of the disclosure the above stated objects are solved by a method for mounting a piston type pump preferably according to the first embodiment, including the steps of: mounting the first secondary stage piston rod and the second primary stage piston on the first eccentric; interference mounting the driving shaft into the first eccentric; inserting the first secondary stage piston rod, the second primary stage piston, the first eccentric and the driving shaft into the piston housing; mounting the second eccentric on the driving shaft and aligning it with the first eccentric; mounting the first primary stage piston and the second secondary stage piston rod on the second eccentric.

According to an aspect, the first eccentric is interference mounted on the stud. According to another aspect, the first secondary stage piston rod, the second primary stage piston, the first eccentric, the driving shaft and/or the stud represent a "piston pack" or at least an intermediate "piston pack" and, as such, are conveniently slid down and/or inserted together into the pump housing.

According to one option, the first secondary stage piston is mounted on the first secondary stage piston rod before the "piston pack" is inserted into the pump housing: in other words, the first secondary stage piston belongs to the "piston pack".

According to an alternative option, the first secondary stage piston is mounted on the first secondary stage piston rod only after the "piston pack" has been inserted into the pump housing.

According to yet another aspect, the first secondary stage piston rod, the second primary stage piston, the first eccentric, the driving shaft and/or the stud, the second eccentric, the second secondary stage piston rod and the first primary stage piston represent a "piston pack" and, as such, are slid down and/or inserted into the pump housing. The first secondary stage piston and/or the second secondary stage piston may or may not belong to the "piston pack": in other words, they may be mounted on their respective secondary stage piston rods before the "piston pack" is inserted into the pump housing or after the "piston pack" in inserted into the pump housing.

Optionally, the "piston pack" also includes a nut mounted on the stud, the nut being in contact force transmitting engagement with the second eccentric.

According to yet another alternative option, the nut is mounted on the "piston pack" only after the "piston pack" has been inserted into the pump housing.

Preferably, the nut is threadedly engaged to the stud.

According to an aspect of the disclosure, the above stated objects are solved by a vehicle, in particular a passenger car, including a piston type pump according to any of the aforementioned embodiments of a piston type pump. It shall, however, also be understood that the pump according to the present disclosure may also be used in applications other than vehicles, and in particular other than braking systems. Other uses of pumps for generating a vacuum on a vehicle can include engine mounts, compressor waste-gate and bypass valves actuation. This type of pump could also feasibly be used to evacuate a housing for a KERS (Kinetic Energy Recovery System) for example.

BRIEF DESCRIPTION OF DRAWINGS

The invention will now be described with reference to the drawings wherein.

DETAILED DESCRIPTION

Figure 1:
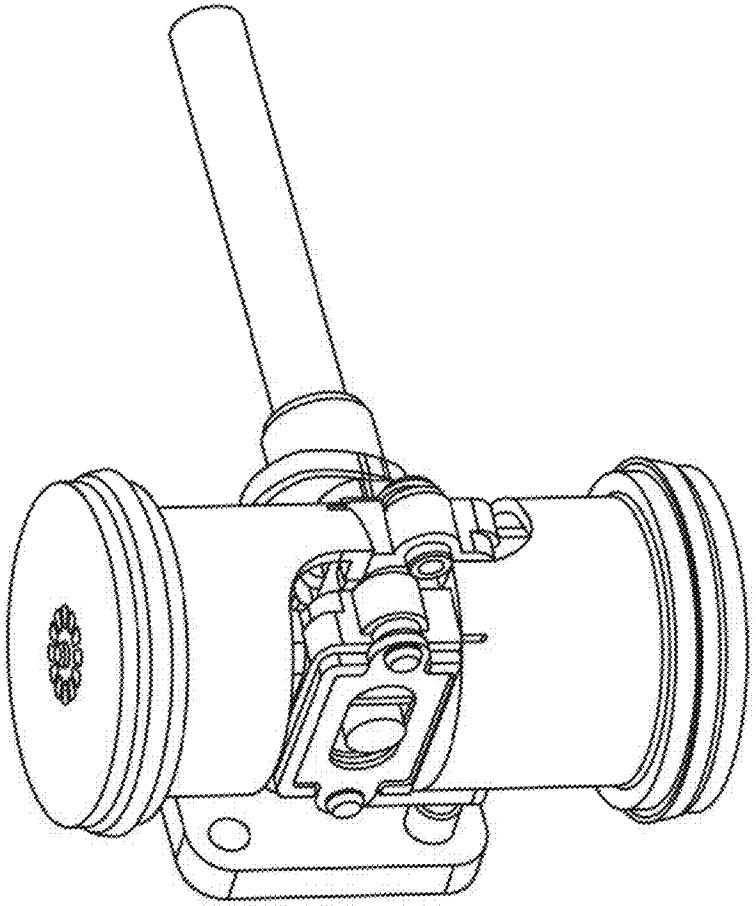
PRIOR ART FIG. 1
FIG. 1 shows a perspective view of a prior art piston type pump including a "Scotch yoke" mechanism.

A piston type pump 1 according to the present disclosure is suitable to be mounted within a vehicle 100 (see FIG. 9) and used as a vacuum pump to provide a vacuum for a braking system or any other consumer in this vehicle. The piston type pump 1 in particular is suitable to be driven by an electric motor which for simplicity is not shown in the drawings.

The following embodiments show the piston type pump 1 prepared to be used as a vacuum pump and to induce a vacuum at a pump inlet (not shown). However, the same construction may also be used as a compressor.

In more detail the piston type pump 1 includes a pump housing 2 which is substantially cylindrical. The pump housing 2 has a pump inlet (not shown) which can be connected to a consumer. Moreover, the pump housing includes a pump outlet (not shown) which opens into the environment. The pump outlet may be formed as a simple opening in the pump housing 2. Fluid, in particular air, which is drawn away from the pump inlet, is not used and only discharged to the environment instead of being provided to any consumer, when the piston type pump 1 is used as a vacuum pump.

Within the pump housing 2 a piston arrangement 8 is provided, which will be described in more detail below. The piston arrangement 8 is connected to a drive shaft 10 which, when driven, sets the piston arrangement 8 into movement for inducing a vacuum at the pump inlet. The drive shaft 10 is rotatable about a rotational axis A and may be connected to an electric motor.

Figure 2:
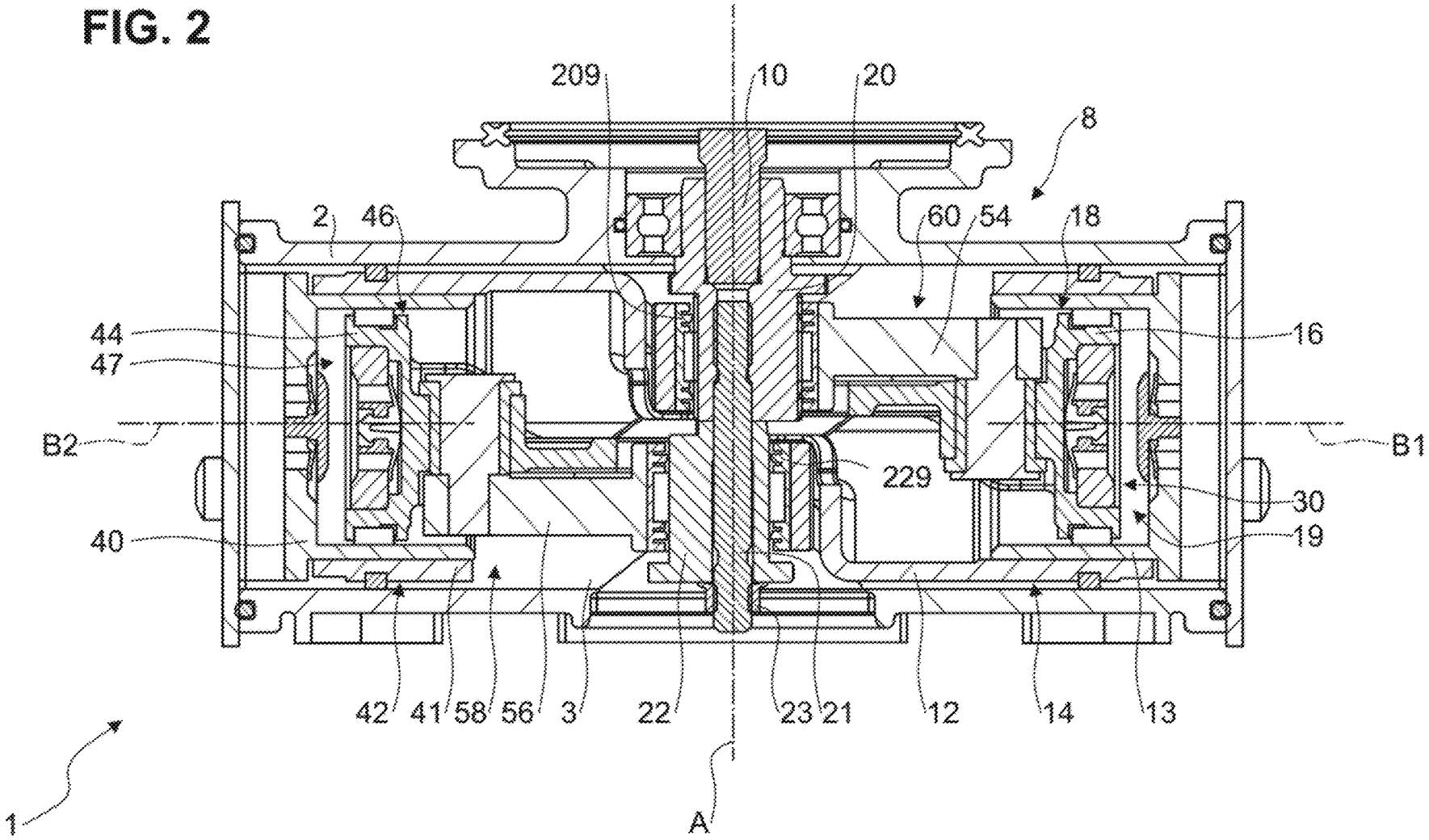
FIG. 2 shows a cut view of the piston type pump of the disclosure.

The piston arrangement 8 according to the embodiment shown in FIG. 2 includes a first primary stage piston 12 which is slidably seated in a first primary stage cylinder 14 formed in the pump housing 2.

The piston type pump 1 according to the shown embodiment is formed as a twin type two-stage piston pump and therefore also includes a first secondary stage piston 16, which is provided within a first secondary stage cylinder 18, which is formed within the first primary stage piston 12. The first primary stage piston 12, therefore, is formed in a hollow manner, to form the first secondary stage cylinder 18. The first primary stage piston 12 includes a first primary stage piston wall 13 which defines the first secondary stage cylinder 18. The first secondary stage cylinder 18 in particular is formed by an inner circumferential surface of the first primary stage piston wall 13 within the first primary stage piston 12.

For movement of the first primary stage piston 12 and the first secondary stage piston 16, the first primary stage piston 12 is driven by a second eccentric 22 of the drive shaft 10 and the first secondary stage piston 16 is driven by a first eccentric 20 of the drive shaft 10. Both the first and the second eccentric 20, 22 are mounted on a stud 21. The first and second eccentrics 20, 22 are phase-shifted by 180°.

In a similar fashion the piston arrangement 8 according to this embodiment also includes a second primary stage piston 40, which is slidably seated in a second primary stage cylinder 42, which again is formed inside the pump housing 2. The complete interior 3 of the pump housing 2 can be formed as a cylindrical hollow portion to form both the first primary stage cylinder 14 and the second primary stage cylinder 42.

Also a second secondary stage piston 44 is provided which is slidably seated in a second secondary stage cylinder 46 formed within the second primary stage piston 40. Again the second primary stage piston 40 includes a second primary stage piston wall 41 which defines the second secondary stage cylinder 46 by its inner circumferential surface restricting a second hollow space 47.

For driving the second primary stage piston 40 and the second secondary stage piston 44, the second primary stage piston 40 is connected to the first eccentric 20 and the second secondary stage piston 44 is connected to the second eccentric 22. Thus, the first eccentric 20 drives the second primary stage piston 40 as well as the first secondary stage piston 16 and in turn the second eccentric 22 drives the first primary stage piston 12 and the second secondary stage piston 44. Therefore, the movement of the pistons is identical, however, phase-shifted by 180°.

Moreover, in FIG. 2 it can be seen that the first primary stage cylinder 14 includes a first central axis B1 and the second primary stage cylinder 42 includes a second central axis B2, which are coaxial. Thus, the first and the second central axes B1, B2 form a single axis on which the first primary stage piston 12 and the second primary stage piston 40 move. When the first secondary stage cylinder 18 and the second secondary stage cylinder 46 are formed concentrically within the respective first primary stage piston 12 and the second primary stage piston 40, also the first secondary stage piston 16 and the second secondary stage piston 44 move coaxially with the first and second central axes B1, B2. Thus, the overall configuration of the piston type pump 1 is a boxer type piston type pump in which the single pistons move in opposing directions. This may lead to a well-balanced configuration.

The first secondary stage piston 16 includes a first piston rod 54 which extends through a first assembly opening 60 in the first primary stage piston wall 13. The portion of the first hollow space 19 which is on the opposite side of the piston rod 54 with respect to the first secondary piston face 30 can be named the first secondary stage working chamber. In the same manner the second secondary stage piston 44 includes a second piston rod 56 which extends through a second assembly opening 58 formed in the second primary stage piston wall 41 of the second primary stage piston 40.

The first primary stage piston 12 and the second secondary stage piston rod 56 are mounted on, and directly driven by, the second eccentric 22. In turn, the first secondary stage piston rod 54 and the second primary stage piston 40 are mounted on, and directly driven by, the first eccentric 20.

The mounting of the first primary stage piston 12 and of the second secondary stage piston rod 56 on the second eccentric 22 may include a needle bearing 229. In turn, the mounting of the first secondary stage piston rod 54 and of the second primary stage piston 40 on the first eccentric 20 may also include a needle bearing 209.

The flow of fluid within the piston type pump of the disclosure is well known in the art and will not be described in detail. However, reference is made to previously mentioned prior art document WO 2019/114923 A1.

Figure 4:
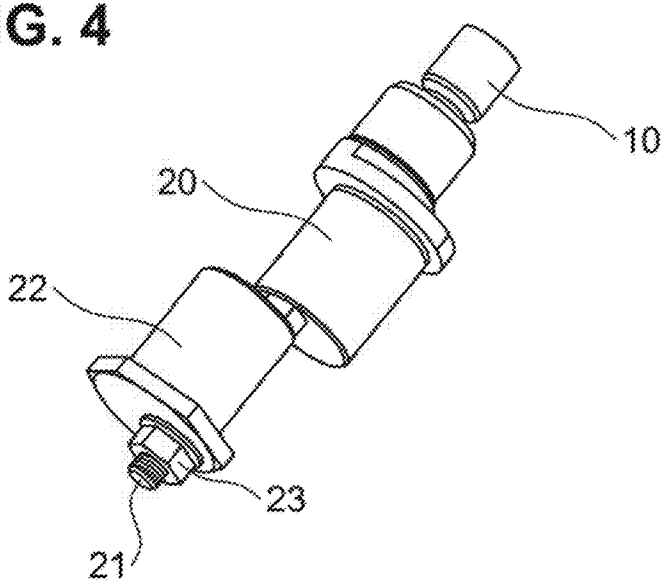
FIG. 4 shows a perspective view of the crank mechanism of FIG. 3.
Figure 5:
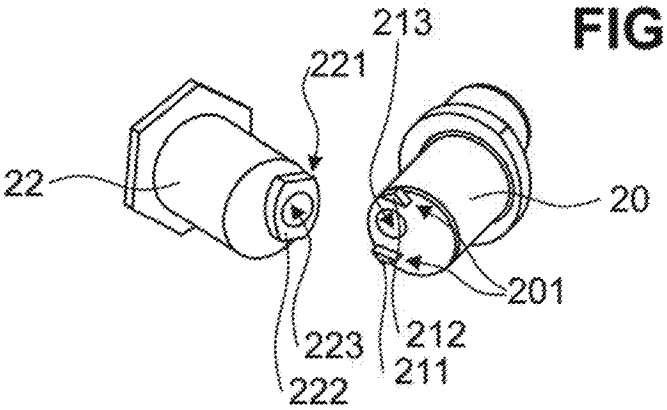
FIG. 5 shows a perspective view of a first eccentric and a second eccentric as part of the crank mechanism of FIGS. 3 and 4.
Figure 3:
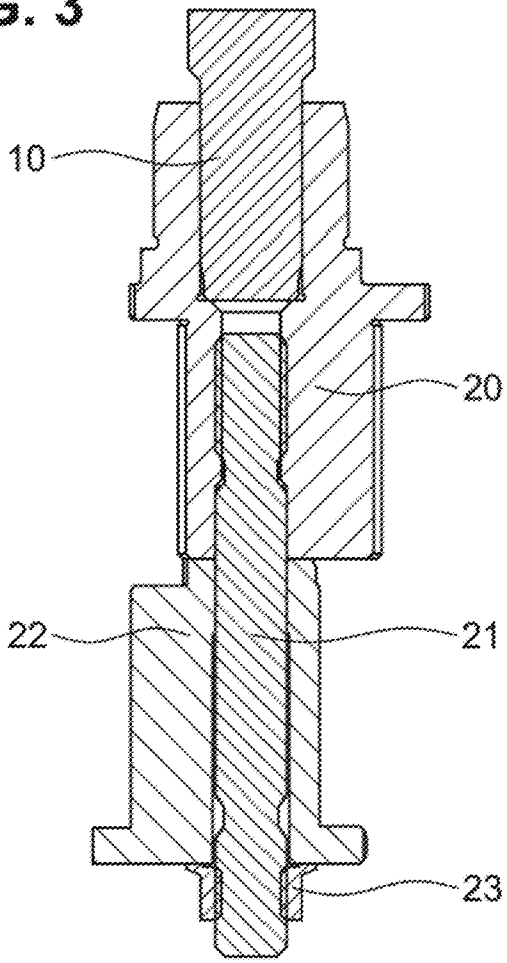
FIG. 3 shows a simplified cut view of the crank mechanism of a first embodiment of the piston type pump of the disclosure.

The crank mechanism of FIG. 2, which is shown in detail in FIG. 3, FIG. 4 and FIG. 5, relates to a first embodiment of the present disclosure and includes a stud 21 fixedly mounted on the driving shaft 10. The first eccentric 20 is fixedly mounted on the driving shaft 10 and/or on the stud 21, for instance by screws or other form-locking mechanisms. Preferably, the first eccentric 20 is fixedly mounted on the driving shaft 10 and/or on the stud 21, through interference mounting. The first eccentric 20 includes a bore 213 to allow the insertion and the mounting on the stud 21 and/or on the driving shaft 10.

In proximity to the bore 213, a first protrusion 211 and a second protrusion 212 are provided, each having at least a flat coupling surface. The second eccentric 22 also includes a bore 223 to allow the insertion and the mounting on the stud 21. In correspondence to, preferably coaxial to, the bore 223, a third protrusion 222 is also provided, the third protrusion 222 having at least two flat coupling surfaces configured to engage, in a predetermined angular way, with the respective flat coupling surfaces of the first and second protrusions 211, 212 provided on the first eccentric 20. This way, it is possible to align the first and the second eccentrics in a predetermined angular fashion. The protrusions 211, 212, 222 are configured to transmit torque between the first and the second eccentrics 20, 22 so that they can jointly rotate around rotational axis A of the driving shaft 10 and of the stud 21. It shall be understood, that in other embodiments, the first and second protrusions 211, 212 are provided on the second eccentric 22, while the third protrusion is provided on the first eccentric 20. Also any other means for at least a partial form-locking torque transmission are envisaged. It also shall be understood that in exchange of the first and second protrusions 211, 212 a groove may be provided on one of the eccentrics 20, 22 in which the third protrusion 222 may engage.

A nut 23 is threadedly fixed on the stud 21 and further secures the second eccentric 22 in both its axial position along the rotational axis A of the stud 21 and in its rotational position in respect of the first eccentric 20.

The assembly of the piston type pump 1 according to the first embodiment of the disclosure may conveniently envisage that at least part of the pistons are assembled together before being slid down the pump housing 2. As a first assembly step, the first secondary stage piston rod 54, together with the first secondary stage piston 16, and the second primary stage piston 40 are mounted on the first eccentric 20. Subsequently, the first eccentric 20 is fixedly mounted on the driving shaft 10 and/or the stud 21, for instance by interference mounting. This way, an intermediate "piston pack" including the driving shaft 10 and/or the stud 21, the first eccentric 20, the first secondary stage piston 16 and its first secondary stage piston rod 54, as well as the second primary stage piston 40, is created. Such an intermediate "piston pack" is then inserted into the pump housing 2. Thereafter, the second eccentric 22 is mounted on the driving shaft 10 and aligned with the first eccentric 20 thanks to the torque-transmitting and aligning arrangement, namely the protrusions, which are provided on both the first and second eccentrics. Finally, the first primary stage piston 12 and the second secondary stage piston rod 56 together with its respective second secondary stage piston 44, are mounted on the second eccentric 22.

Figure 6:
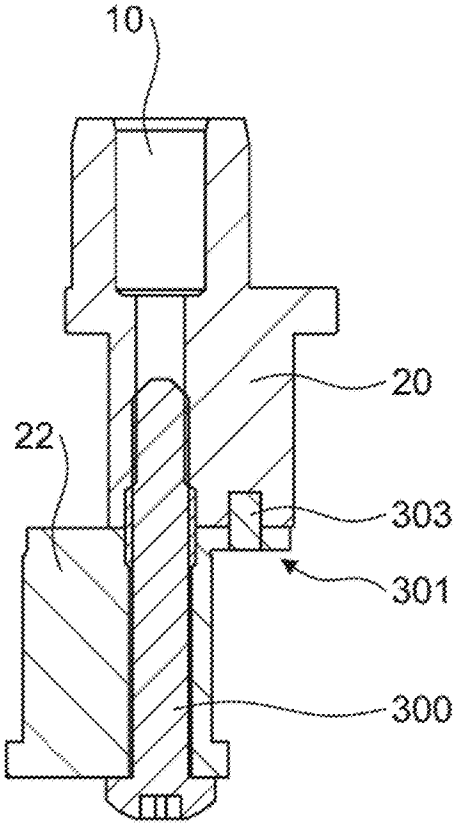
FIG. 6 shows a simplified cut view of the crank mechanism of a second embodiment of the piston type pump of the disclosure.
Figure 7:
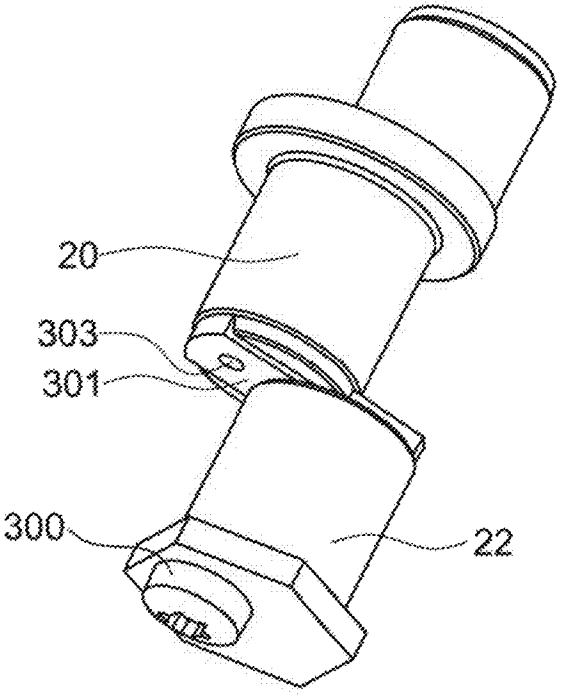
FIG. 7 shows a perspective view of the crank mechanism of FIG. 6.
Figure 8:
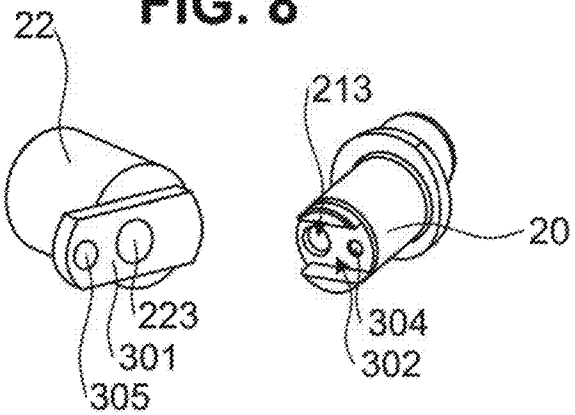
FIG. 8 shows a perspective view of a first eccentric and of second eccentric making part of the crank mechanism of FIGS. 6 and 7; and, FIG. 9 shows a schematic view of a vehicle.

FIG. 6, FIG. 7 and FIG. 8 show a crank mechanism according to a second, alternative embodiment of the present disclosure. According to such alternative embodiment, the driving shaft 10, the first eccentric 20 and the second eccentric 22 are held together with a cap screw 300. The first eccentric 20 includes a recess 302 and a bore 213 to allow the insertion and the mounting on the cap screw 300. The first eccentric 20 also includes a second bore 304, to allow the insertion and the mounting of a pin 303.

The second eccentric 22 includes a bore 223 to allow the insertion and the mounting on the cap screw 300, and a flange 301. The flange 301 is configured to fit into the recess 302 of the first eccentric 20 and includes a second bore 305 to allow the insertion and the mounting of the pin 303. In other words, the pin 303 secures the fixed coupling of the flange 301 of the second eccentric 22 with the recess 302 of the first eccentric 20 and as a result, the first and second eccentrics 20, 22 are aligned at a predetermined rotational angle, and they are capable of jointly rotating. Preferably, the pin 303 is inserted into the second bore 304 on the first eccentric 20 and into the second bore 305 on the flange 301 through interference mounting.

Figure 9:
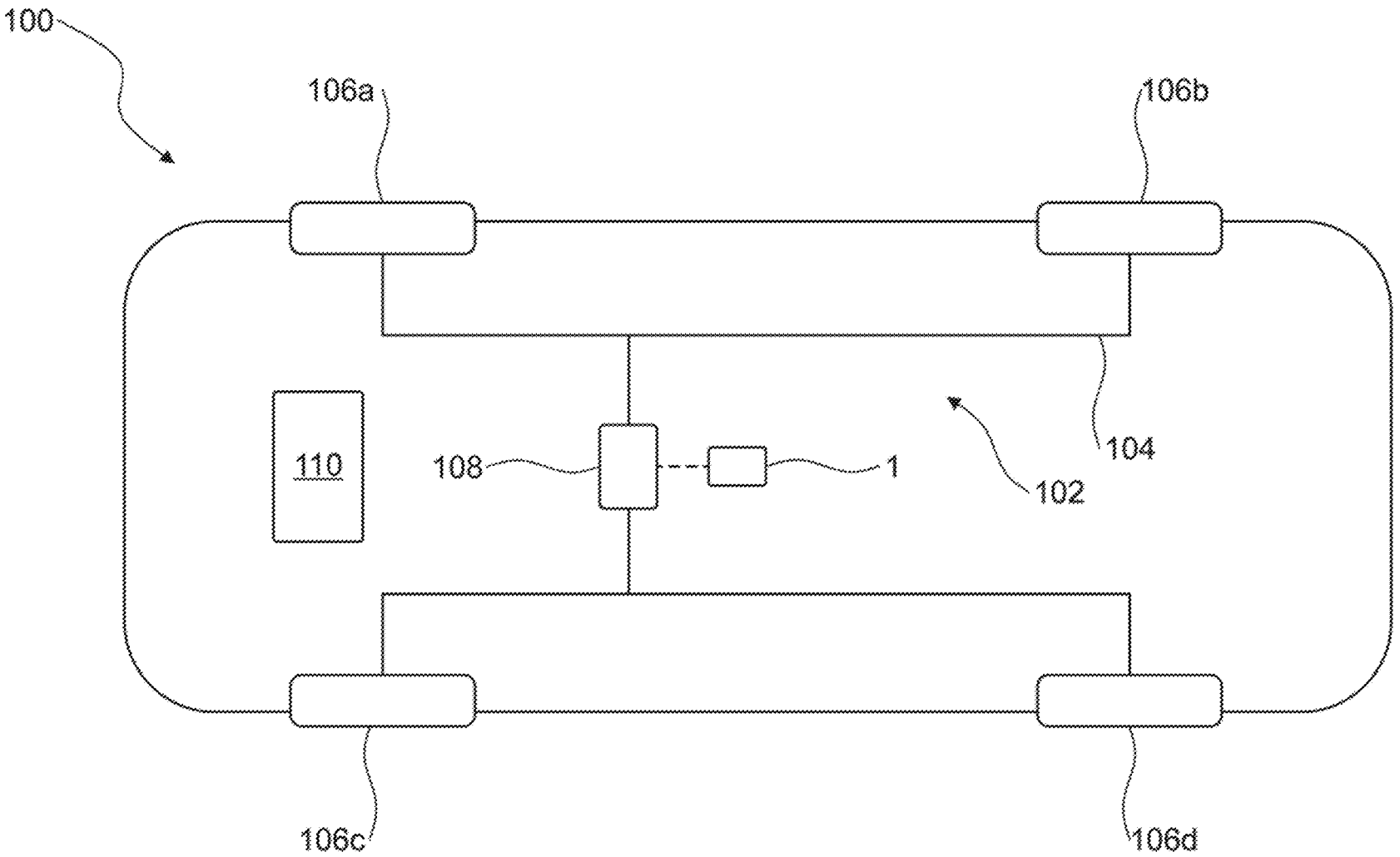

FIG. 9 now depicts a schematic drawing of a vehicle 100. Vehicle 100 preferably is formed as a passenger car, or a light truck and includes a pneumatic braking system 102. The braking system 102 is shown by lines 104 leading to wheels 106*a*, 106*b*, 106*c*, 106*d* for providing the wheels 106*a*, 106*b*, 106*c*, 106*d* with the respective braking pressure. Lines 104 are connected to a central module 108. The vehicle 100 moreover includes an engine 110 and a piston type pump 1 according to the disclosure, which is herein used as a vacuum pump 1. The piston type pump 1 provides the braking system 102 with a vacuum, which, for example, could be used by a brake booster of the braking system 102, which could be implemented in the central module 108.

It is understood that the foregoing description is that of the preferred embodiments of the invention and that various changes and modifications may be made thereto without departing from the spirit and scope of the invention as defined in the appended claims.

LIST OF REFERENCE SIGNS (PART OF THE DESCRIPTION)

1 piston type pump
2 pump housing 2
3 interior of the pump housing
8 piston arrangement
10 driving shaft
12 first primary stage piston
13 first primary stage piston wall
14 first primary stage cylinder
16 first secondary stage piston
18 first secondary stage cylinder
19 first hollow space
20 first eccentric
21 stud
22 second eccentric
23 nut
30 first secondary piston face
40 second primary stage piston
41 second primary stage piston wall
42 second primary stage cylinder
44 second secondary stage piston
46 second secondary stage cylinder
47 second hollow space
54 first secondary stage piston rod
56 second secondary stage piston rod
58 second assembly opening
60 first assembly opening
100 vehicle
102 pneumatic braking system
104 lines leading to wheels
106*a* wheel (front right)
106*b* wheel (rear right)
106*c* wheel (front left)
106*d* wheel (rear left)
108 central module
110 engine
201 first torque-transmitting and aligning arrangement
209 needle bearing (first eccentric)
211 (first) protrusion on the first eccentric
212 (second) protrusion on the first eccentric
213 bore on the first eccentric
221 second torque-transmitting and aligning arrangement
222 (third) protrusion on the second eccentric
223 bore on the second eccentric
229 needle bearing (second eccentric)
300 cap screw
301 flange
302 recess
303 pin
304 second bore on first eccentric
305 second bore on second eccentric
A rotational axis of drive shaft
B1 first central axis
B2 second central axis

The invention claimed is:

1. A piston type pump comprising:

a pump housing having a piston arrangement connected to a driving shaft which, when driven, sets said piston arrangement into movement;

said piston arrangement including a first primary stage piston, a first secondary stage piston, a second primary stage piston, and a second secondary stage piston;

said first primary stage piston being slidably seated in a first primary stage cylinder formed in said pump housing;

said first secondary stage piston being slidably seated in a first secondary stage cylinder formed in said first primary stage piston;

said second primary stage piston being slidably seated in a second primary stage cylinder formed in said pump housing;

said second secondary stage piston being slidably seated in a second secondary stage cylinder formed in said second primary stage piston;

said driving shaft including a first eccentric and a second eccentric which are phase shifted by 180°;

said first secondary stage piston including a first secondary stage piston rod and said second secondary stage piston including a second secondary stage piston rod;

said first primary stage piston and said second secondary stage piston rod being configured to be mounted on and directly driven by said second eccentric; and, said first secondary stage piston rod and said second primary stage piston being mounted on, and directly driven by, said first eccentric, wherein said driving shaft includes a stud, said first eccentric and said second eccentric being mounted on said stud, and said driving shaft and said stud are separate components.

2. The piston type pump of claim 1, wherein at least one of said first eccentric and said second eccentric is fixedly mounted on said stud.

3. The piston type pump of claim 1, wherein at least one of said first eccentric and said second eccentric is in threaded engagement with said stud.

4. The piston type pump of claim 1, wherein said first eccentric is provided with a first torque-transmitting and aligning arrangement configured to engage in a predetermined angular way with a second torque-transmitting and aligning arrangement provided on said second eccentric.

5. The piston type pump of claim 4, wherein said first torque-transmitting and aligning arrangement provided on said first eccentric has a first protrusion and a second protrusion; and, said second torque-transmitting and aligning arrangement provided on said second eccentric has at least a third protrusion configured to fit with said first protrusion and said second protrusion provided on said first eccentric.

6. The piston type pump of claim 5, wherein said third protrusion is coaxial to a bore for insertion of said stud.

7. The piston type pump of claim 1, further comprising a nut disposed on said stud; and, said nut being in threaded engagement with said stud and in contact force transmitting engagement with said second eccentric.

8. A vehicle comprising the piston type pump of claim 1.

9. The vehicle of claim 8, wherein the vehicle is a passenger car or a commercial vehicle.

10. A piston type pump comprising:

a pump housing having a piston arrangement connected to a driving shaft which, when driven, sets said piston arrangement into movement;

said piston arrangement including a first primary stage piston, a first secondary stage piston, a second primary stage piston, and a second secondary stage piston;

said first primary stage piston being slidably seated in a first primary stage cylinder formed in said pump housing;

said first secondary stage piston being slidably seated in a first secondary stage cylinder formed in said first primary stage piston;

said second primary stage piston being slidably seated in a second primary stage cylinder formed in said pump housing;

said second secondary stage piston being slidably seated in a second secondary stage cylinder formed in said second primary stage piston;

said driving shaft including a first eccentric and a second eccentric which are phase shifted by 180°;

said first secondary stage piston including a first secondary stage piston rod and said second secondary stage piston including a second secondary stage piston rod;

said first primary stage piston and said second secondary stage piston rod being configured to be mounted on and directly driven by said second eccentric; and, said first secondary stage piston rod and said second primary stage piston being mounted on, and directly driven by, said first eccentric, wherein said driving shaft includes a cap screw; and, said first eccentric and said second eccentric are mounted on said cap screw, wherein said driving shaft and said cap screw are separate components.

11. The piston type pump of claim 10, wherein at least one of said first eccentric and said second eccentric is in threaded engagement with said cap screw.

12. The piston type pump of claim 10, wherein said second eccentric is provided with a flange configured to fit with a recess provided on said first eccentric.

13. The piston type pump of claim 12 further comprising a pin configured to fixedly secure said flange provided on said second eccentric with said recess provided on said first eccentric.

14. A vehicle comprising the piston type pump of claim 10.

15. A method for mounting a piston type pump, the method comprising:

mounting a first secondary stage piston rod and a second primary stage piston on a first eccentric;

interference mounting a driving shaft into the first eccentric;

inserting the first secondary stage piston rod, the second primary stage piston, the first eccentric and the driving shaft into a pump housing;

mounting a second eccentric on the driving shaft and aligning it with the first eccentric; and, mounting the first primary stage piston and the second secondary stage piston rod on the second eccentric, wherein said driving shaft includes a stud, said first eccentric and said second eccentric being mounted on said stud, and said driving shaft and said stud are separate components or wherein said driving shaft includes a cap screw; and, said first eccentric and said second eccentric are mounted on said cap screw, wherein said driving shaft and said cap screw are separate components.

* * * * *